United States Patent [19]

Kouns et al.

[11] Patent Number: 4,715,788

[45] Date of Patent: Dec. 29, 1987

[54] SERVO CONTROL VARIABLE DISPLACEMENT PRESSURE COMPENSATED PUMP

[75] Inventors: Herbert H. Kouns, Camarillo; Loren D. Gardner, Granada Hills, both of Calif.

[73] Assignee: Abex Corporation, Boston, Mass.

[21] Appl. No.: 450,299

[22] Filed: Dec. 16, 1982

[51] Int. Cl.[4] ..... F04B 1/26

[52] U.S. Cl. ..... 417/218; 417/222; 60/443; 60/452

[58] Field of Search ..... 417/217, 218, 219, 220, 417/221, 222, 212; 91/506; 60/443, 452, 444

[56] References Cited

U.S. PATENT DOCUMENTS

| | | | |
|---|---|---|---|
| 3,250,227 | 5/1966 | Kouns | 417/222 X |
| 3,286,601 | 11/1966 | Jones | 417/222 X |
| 3,302,585 | 2/1967 | Adams et al. | 417/217 |
| 3,401,711 | 9/1968 | Kubilos | 137/625.63 X |
| 3,830,594 | 8/1974 | Hein et al. | 417/217 |
| 3,864,063 | 2/1975 | Martin | 417/222 |
| 3,985,469 | 10/1976 | Ohta | 91/506 X |
| 4,013,381 | 3/1977 | Hein et al. | 417/222 |
| 4,102,607 | 7/1978 | Benson | 417/222 |
| 4,289,452 | 9/1981 | Kubilos | 417/222 |

*Primary Examiner*—Edward K. Look
*Assistant Examiner*—Paul F. Neils
*Attorney, Agent, or Firm*—Thomas S. Baker, Jr.

[57] ABSTRACT

A variable displacement, pressure compensated, axial piston pump has an electrohydraulic servo valve connected to the pressure compensator mechanism to enable the pressure setting of the mechanism to be changed from a remote location.

3 Claims, 3 Drawing Figures

FIG. 1
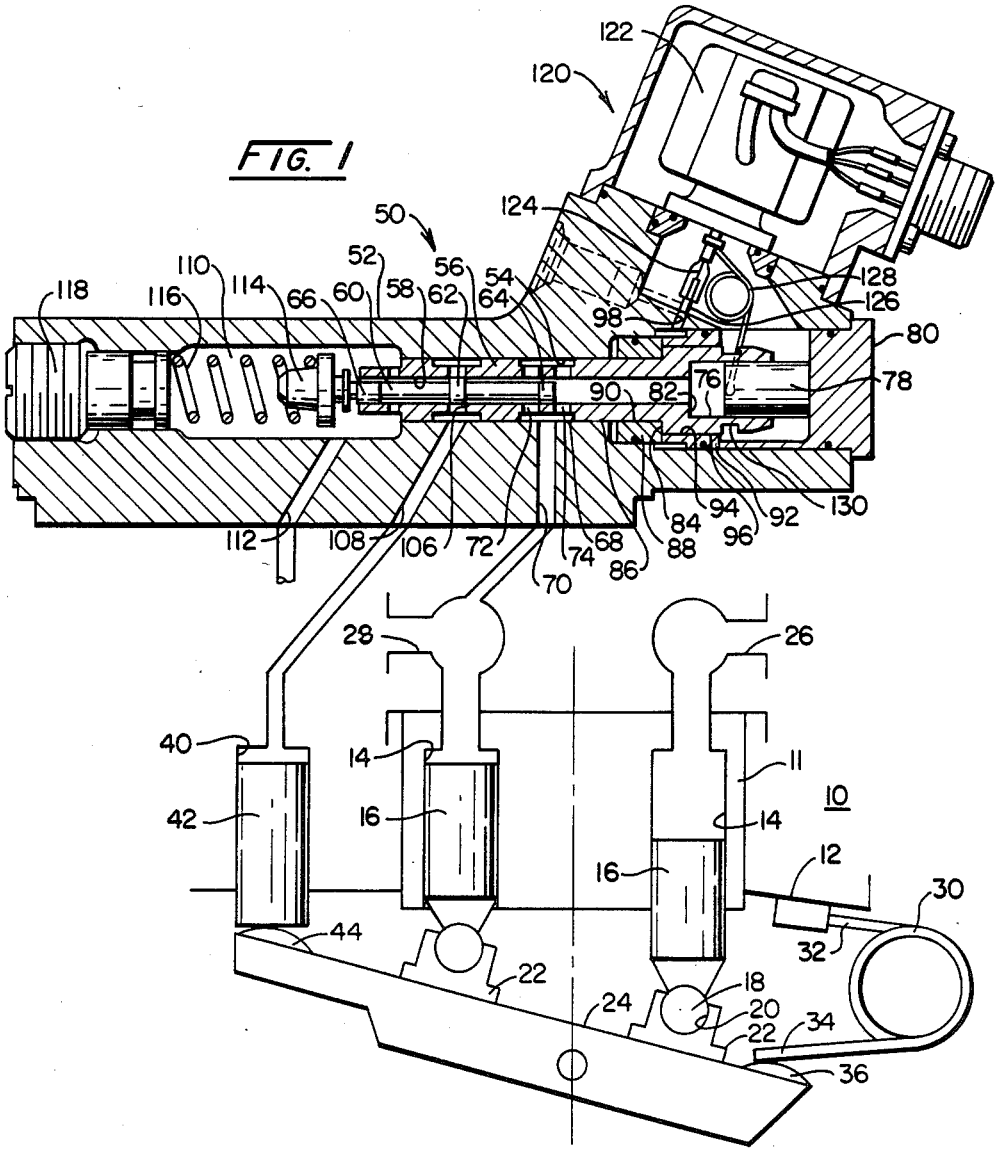
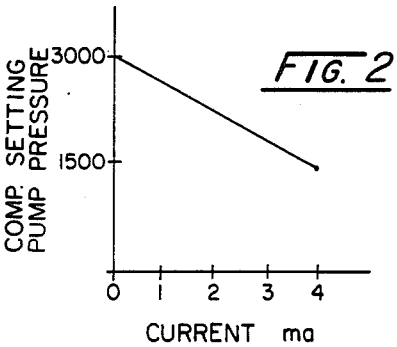
FIG. 2
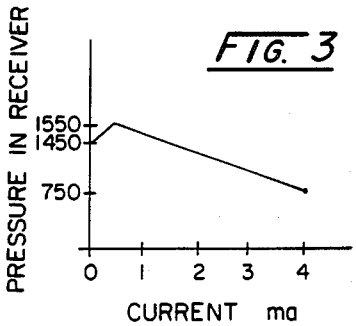
FIG. 3

SERVO CONTROL VARIABLE DISPLACEMENT PRESSURE COMPENSATED PUMP

BACKGROUND OF THE INVENTION

This invention relates to a variable displacement, pressure compensated pump. More specifically, it relates to a variable displacement, pressure compensated pump in which a servo mechanism adjusts the pressure setting of the pressure compensator mechanism.

A variable displacement, pressure compensated pump can be used in a hydraulic system to provide driving fluid for a plurality of hydraulic actuators. In such a system, the variable displacement pump is driven by a prime mover such as an electric motor. The pump draws low pressure fluid into an inlet port from a reservoir and delivers fluid under pressure from its outlet port to flow control valves which operate the hydraulic actuators. The function of the pressure compensator is to maintain the pressure of the fluid in the outlet port of the pump at a constant set pressure. The compensator responds to changes in the pressure of the outlet fluid by increasing pump displacement when the pressure of the outlet fluid falls below the pressure setting of the pressure compensator and by decreasing pump displacement when the pressure of the fluid in the outlet exceeds the pressure setting of the pressure compensator.

In some hydraulic systems, such as those used on an aircraft, the pressure setting of the pressure compensator is set high enough to ensure that there is adequate pressure fluid for all of the hydraulic actuators which may operate at any one time. The pressure setting is maintained at this high level even though multiple hydraulic actuators may operate simultaneously very infrequently (such as during takeoff or landing of the aircraft) and outlet pressure fluid at the high pressure setting is required during only a small percentage of the time the hydraulic system is operating. The pressure setting of the pressure compensator is set at this high level because it is difficult to change the setting of a pressure compensator during normal system operation.

One problem with having to set the pressure compensator setting of a pump at the high level required for the maximum anticipated load by the hydraulic actuators, i.e., the worst possible case, is that in all hydraulic systems there is some leakage of fluid past pistons, spools and other internal mechanisms, and the amount of fluid leakage increases with pressure. Leakage must be made up through a pump with increased pumping capacity which requires a larger prime mover. This increases the weight of the unit which is particularly undesirable in an aircraft. An additional problem with having to maintain a high pressure compensator setting is the power required to drive a pump increases exponentially with pressure. As the required amount of power increases, fuel consumption increases and the amount of waste heat from the prime mover which must be dissipated also increases. A further problem with having to maintain a high pressure compensator setting is that in most instances the power required to operate a hydraulic actuator is much less than the capacity available. Consequently, when a flow control valve is operated to supply fluid to a hydraulic actuator, energy is lost through throttling of the high pressure fluid down to the level required by the hydraulic actuator. This results in additional heat which must be dissipated.

It is desirable to provide a variable displacement, pressure compensated pump for a system in which multiple hydraulic actuators are operated in which the pressure setting of the pressure compensator can be adjusted to meet the anticipated load demand of the system, such that the pressure setting of the pressure compensator can be maintained at less than the output pressure required for simultaneous operation of all the hydraulic actuators in the system. The system for adjusting the pressure setting of the pressure compensator must be fail safe, such that in the event of an interruption of electrical power or hydraulic fluid, the pressure setting of the pressure compensator is at the maximum and sufficient to meet the demands of simultaneous operation of all hydraulic actuators in the system.

SUMMARY OF THE INVENTION

The instant invention relates to a pressure compensated, variable displacement pump having a fluid inlet, a fluid outlet and a displacement adjustment mechanism movable between a position of maximum fluid displacement and a position of minimum fluid displacement. The pressure compensator mechanism maintains the pressure of the fluid in the outlet at a constant set value. This mechanism includes a spool and sleeve which cooperate to provide a control port which is connected to the displacement adjustment mechanism. A spring acts on the spool to provide a pressure setting for the pressure compensator mechanism. A servo valve is connected to the sleeve and supplies control fluid to an area on the sleeve to move the sleeve with respect to the spring and spool to thereby adjust the pressure setting of the pressure compensator. The pressure of the control fluid acting on the sleeve is directly proportional to the current supplied to the servo valve. In the event the current supplied to the servo valve is interrupted, the pressure of the control fluid drops to a minimum and the sleeve is moved to a position in which the pressure compensator is at its maximum setting.

DESCRIPTION OF THE DRAWINGS

FIG. 1 is a sectional view of the electrohydraulic servo valve adjusted pressure compensator mechanism of the instant invention connected to a variable displacement pump;

FIG. 2 is a graph illustrating the relationship between the pressure setting of the pressure compensator and the current input to the electrohydraulic servo valve; and FIG. 3 is a graph showing the relationship between the control pressure and the current input to the electrohydraulic servo valve.

DESCRIPTION OF THE PREFERRED EMBODIMENT

Referring to FIG. 1, a variable displacement, axial piston pump 10 includes a barrel 11 rotatably mounted in a housing 12, which has a plurality of piston bores 14 equally spaced circumferentially about its rotational axis. A piston 16 is received in each bore 14. A portion of the piston 16 which projects from each bore 14 has a ball 18 formed on the end thereof. Each ball 18 is received in a socket 20 formed in a shoe 22 to pivotally attach the shoe 22 to a piston 16. Each of the piston shoes 22 is retained against a pivotally mounted thrust plate 24 by a shoe holddown mechanism (not shown). As barrel 11 is rotated by a prime mover, such as an electric motor or diesel engine (not shown), the shoes 22 on the ends of the pistons 16 slide over the surface of thrust plate 24. If thrust plate 24 is inclined from the neutral or minimum displacement position in which the surface of thrust plate 24 is perpendicular to the axis of barrel 11, pistons 16 reciprocate in bores 14. As the pistons 16 reciprocate, fluid at low pressure is drawn from an inlet port 26 and fluid at high pressure is expelled from an outlet port 28.

A spring 30 has one end 32 affixed to the pump housing 12 and the other end 34 acting against a surface 36 on one end of thrust plate 24. In this way thrust plate 24 is biased toward the maximum displacement position, i.e., its maximum angular inclination shown in FIG. 1. A bore 40 formed in housing 12 receives a piston 42 which acts against a surface 44 on the end of thrust plate 24 opposite the surface 36 engaged by spring 30. Fluid is supplied to bore 40 to move piston 42 against the end of thrust plate surface 44 to pivot thrust plate 24 against the force of spring 30 to a reduced displacement position, as will be explained hereinafter.

The pressure in fluid outlet 28 is set by a pressure compensator mechanism 50. Mechanism 50 includes a housing 52 having a longitudinal bore 54 which receives a slidable sleeve 56. An axial bore 58 in sleeve 56 receives a slidable spool 60 which has a central control land 62 and a pair of lands 64, 66 at each end thereof. Sleeve 56 has a port 68 which is connected to pump outlet 28 by a passage 70. Port 68 is connected to spool bore 58 by a pair of radial bores 72, 74 which open on opposite sides of land 64. Consequently, outlet pressure fluid is supplied to spool bore 58 and to one side of control land 62. The right side of spool bore 58 opens into an enlarged bore 76 which is closed by stationary piston 78 which is received in bore 76 and acts against a plug 80 which closes access to the sleeve 56 and spool 60. Since piston 78 seals the end of bore 58 outlet pressure fluid is confined in bore 58 and acts against ring-shaped surface 82 formed at the bottom of bore 76 to bias sleeve 56 to the left. Leftward travel of sleeve 56 is stopped when a shoulder 84 formed on the outer surface 86 of sleeve 56 engages a guide 88 which has a sleeve receiving bore 90. Guide 88 is retained in position by a second guide 92 which has a bore 94 which receives the enlarged end of sleeve 56 and plug 80 which engages guide 92. It should be noted that clearance is provided between the guides 88, 92 to provide a passage for control fluid from housing passage 98 to the area on sleeve 56 formed by shoulder 84, as described hereinafter. Additionally, the area of surface 82 in the bottom of bore 76 is one-half the area of shoulder 84 on the outer surface of sleeve 56.

Sleeve 56 has a control port 106 which is connected to swash plate engaging piston 42 through a passage 108. The left end of sleeve bore 54 opens into an enlarged cavity 110. Cavity 110 is drained to tank through a passage 112. The portion of spool 60 to the left of control land 62 also connects to cavity 110. The left end of spool 60 projects into cavity 110 and receives a hat-shaped element 114. Element 114 receives one end of a compensator spring 116. The other end of spring 116 engages an adjustment screw 118 which is threaded into housing 52 in axial alignment with spool 60 and sleeve 56 and defines a portion of cavity 110. Adjustment screw 118 is rotated to increase or decrease the force of compensator spring 116 acting on the end of spool 60 to thereby increase or decrease the maximum pressure setting of the fluid in outlet 28. Operation of pressure compensator mechanism 50 will now be described.

As previously mentioned, pressure fluid in outlet 28 is supplied to spool bore 58 through passage 70 and radial bores 72, 74. This fluid acts against the right side of control land 62 to bias spool 60 to the left in opposition to the force of compensator spring 116 which sets the pressure of compensator mechanism 50. If the pressure of fluid in outlet 28 acting on control land 62 exceeds the pressure setting of compensator mechanism 50 and overcomes spring 116, control land 62 is moved to the left of control port 106 and outlet pressure fluid flows through passage 108 and into bore 40 to act on piston 42. Piston 42 acts against thrust plate surface 44 to reduce the angle of thrust plate 24 and the displacement of pump 10. Outlet pressure fluid is supplied to piston 42 to reduce the displacement of pump 10 until the pressure of fluid in outlet 28 reaches the pressure setting of compensator mechanism 50. At this time, the force of spring 116 will move spool 60 to the right and control land 62 will cover control port 106 to prevent the passage of outlet pressure fluid to piston 42.

If the pressure of the fluid in outlet 28 falls below the pressure set by spring 116 in compensator mechanism 50, the force of spring 116 will cause spool 60 and control land 62 to move to the right of control port 106. This opens port 106 and passage 40 to cavity 110 which is connected to tank. This permits fluid to drain from bore 40 and allows spring 30 to move thrust plate 24 to a position of increased pump displacement. Bore 40 will remain open to cavity 110 until the pressure of fluid in outlet 28 reaches the setting of compensator mechanism 50. At this time the pressure of fluid in outlet 28 will move spool 60 to the left and land 62 will seal control port 106.

The servo valve 120 which adjusts the pressure setting of the pressure compensator mechanism 50 will now be described. Servo valve 120 is an electrohydraulic jetpipe single port servo valve of the general type shown and described in U.S. Pat. No. 3,401,711, assigned to the assignee of the instant invention and hereby incorporated by reference thereto. The function of the servo valve 120 to adjust the pressure setting of the mechanism 50 is quite straight forward. It consists of supplying a control fluid, to housing passage 98 and thence to shoulder 84 formed on the outer surface of sleeve 56 to cause sleeve 56 to move with respect to compensator spring 116. In FIG. 1, sleeve 56 is positoned as far to the left as it can travel. In this position shoulder 84 abuts guide 88. This position provides the maximum pressure setting for compensator mechanism 50 as preset by adjustment screw 118. This is because control port 106 is as far to the left of passage 108 as it can travel. This requires pressure fluid acting on control land 62 to compress compensator spring 116 a maximum amount before control land 62 is moved far enough to the left to connect outlet pressure fluid to passage 108 and piston 42, which occurs when pressure in outlet 28 has reached the setting of spring 116. Any position of sleeve 56 to the right of that shown in FIG. 1 enables pressure fluid in outlet port 28 to move control land 62 to uncover control port 106 at less pressure because less compression of compensator spring 116 is required. Consequently, as sleeve 56 is moved to the right the setting of pressure compensator mechanism 50 is reduced.

The electrohydraulic servo valve 120 of the instant invention includes a torque motor 122 which operates to bend a jet tube 124, as is well-known in the art. Control fluid is continuously supplied to jet tube 124 from outlet port 28 through a passage (not shown). The control fluid exits from jet tube 124 into a receptor port 126 which is connected to housing passage 98. Passage 98 is connected to surface 84 on sleeve 56 through a clearance between guides 88, 92. Thus, control fluid acts on sleeve surface 84 to move sleeve 56 to the right to reduce the pressure setting of compensator mechanism 50. A feedback spring 128 is connected between jet tube 124 and a groove 130 formed in the outer surface of sleeve 56. Feedback spring 128 closes the command loop between torque motor 122 acting on jet tube 124 and the position of sleeve 56.

When no current is supplied to torque motor 122 jet tube 124 is not bent and is displaced from receptor port 126 by approximately 0.004". If it is assumed that compensator spring 116 provides an initial pressure setting of 3000 psi for compensator mechanism 50, approximately 1450 psi fluid is supplied to receptor port 126 and to shoulder 84 on the outer surface of sleeve 56 through housing bore 98 when no current is supplied to torque motor 122. Since the area of shoulder 84 is twice the area of ring-shaped surface 82 formed between sleeve bores 58 and 76, control pressure in excess of 1500 psi must act on shoulder 84 when fluid in outlet 28 and acting on sleeve surface 82 is at 3000 psi before sleeve 56 can move to the right. In order to increase the pressure of the control fluid acting on shoulder 84 jet tube 124 must be biased towards receptor port 126.

Referring to FIG. 3, it can be seen that as additional current is supplied to torque motor 122 the control pressure increases above 1500 psi to start sleeve 56 moving to the right and then decreases. The control pressure decreases as additional current is supplied to torque motor 122 and jet tube 124 moves closer to receptor port 126 because, while this is happening, sleeve 56 is moving to the right and the setting of pressure compensator mechanism 50 is being reduced. As it is reduced, the pressure of fluid in outlet 28 which is also supplied to jet tube 124 is also reduced. Referring to FIG. 2, it can be seen that as the amount of current supplied to torque motor 122 is increased, the setting of pressure compensator mechanism 50 is reduced. The maximum reduction in compensator setting occurs at a current of approximately 4 milliamps. At 4 milliamps current input to torque motor 122 jet tube 124 is centered over receptor port 126. If current above 4 milliamps is supplied to torque motor 122 jet tube 124 is displaced on the opposite side of receptor port 126 and the compensator setting of the pump increases in the same manner as if current input to torque motor 122 is reduced from 4 milliamps.

Referring to FIGS. 2 and 3, it can be seen that the change of the pressure setting of compensator mechanism 50 is linear with respect to the current supplied to torque motor 122. It should be noted that if there is a power failure and the current input to torque motor 122 drops to zero, sleeve 56 remains in its leftmost position which provides the maximum setting for compensator mechanism 50. Sleeve 56 also goes to the leftmost position if there is a power surge and an excessive amount of current is supplied to torque motor 122. Furthermore, if the pressure of the hydraulic fluid acting on sleeve shoulder 84 drops for any reason, such as a plugged line or a plugged filter, sleeve 56 will also go to its leftmost position.

Although an electrohydraulic servo valve 120 is shown for moving sleeve 56 to adjust the pressure setting of compensator mechanism 50, any type of servo valve mechanism can be used. The servo valve can be strictly mechanical, air-operated or hydraulic, as well as electrohydraulic. It is simply necessary for some type of servo valve mechanism to be able to move sleeve 56 to adjust the pressure setting of compensator mechanism 50. The servo valve must be operable from a remote location, such as the cockpit of an aircraft, and must be fail safe.

From the above it can be seen that the servo valve adjusted pressure compensator mechanism 50 of the instant invention permits the outlet pressure of a pump to be set at any desired level from a remote location and is fail safe. Additionally, the pressure setting of the compensator mechanism 50 is proportional to the current input to the servo valve 120.

Although a preferred embodiment of the invention has been illustrated and described, it will be apparent to those skilled in the art that various modifications may be made without departing from the spirit and scope of the present invention.

What is claimed is:

1. A variable displacement pump comprising: a fluid inlet and a fluid outlet; a displacement adjustment mechanism movable between a position of maximum fluid displacement and a position of minimum fluid displacement; means biasing the displacement adjustment mechanism towards the maximum fluid displacement position; a pressure compensator mechanism for maintaining the pressure of the fluid in the outlet at a constant set value, having a housing, a first bore in the housing, a sleeve received in the first bore, and movable between a first position which provides a maximum setting for the pressure compensator mechanism and a second position which provides a minimum setting for the pressure compensator mechanism, a longitudinal bore in the sleeve, a spool received in the longitudinal bore, a control land on the spool which cooperates with a control port in the sleeve and a spring which acts on the spool for providing a pressure setting for the pressure compensator mechanism; and conduit means for connecting the control port to the displacement adjustment mechanism wherein outlet pressure fluid is supplied to one side of the control land and a low pressure conduit is connected to the other side of the control land and the spool shifts to connect outlet pressure fluid to the control port and to the displacement adjustment mechanism to cause it to overcome the biasing means and reduce the displacement of the pump when the pressure of the fluid in the outlet exceeds the pressure setting of the pressure compensator mechanism and the spool shifts to connect the low pressure conduit to the control port and to the displacement adjustment mechanism to allow the biasing means to increase the displacement of the pump when the pressure of the fluid in the outlet falls below the pressure setting of the pressure compensator mechanism, characterized by control means for positioning the sleeve in the first bore intermediate the first and second positions to change the position of the control port with respect to the spring and spool to thereby set the pressure of the pressure compensator mechanism between its maximum and minimum settings.

2. The variable displacement pump set forth in claim 1 including a first area on the sleeve wherein outlet pressure fluid acts on the first area to bias the sleeve and the control port toward the spring to thereby increase the pressure setting of the pressure compensator mechanism and a second area formed on the sleeve, the second area being greater than the first area, wherein the control means includes means for supplying a control fluid to the second area and the pressure of the control fluid is modulated to set the position of the sleeve and the control port intermediate the first and second positions.

3. A variable displacement pump comprising: a fluid inlet and a fluid outlet; a displacement adjustment mechanism movable between a position of maximum fluid displacement and a position of minimum fluid displacement; means biasing the displacement adjustment mechanism towards the maximum fluid displacement position; a pressure compensator mechanism for maintaining the pressure of the fluid in the outlet at a constant set value, having a housing, a first bore in the housing, a sleeve received in the first bore, a longitudinal bore in the sleeve, a spool received in the longitudinal bore, a control land on the spool which cooperates with a control port in the sleeve and a spring which acts on the spool for providing a pressure setting for the pressure compensator mechanism; and conduit means for connecting the control port to the displacement adjustment mechanism wherein outlet pressure fluid is supplied to one side of the control land and a low pressure conduit is connected to the other side of the control land and the spool shifts to connect outlet pressure fluid to the control port and to the displacement adjustment mechanism to cause it to overcome the biasing means and reduce the displacement of the pump when the pressure of the fluid in the outlet exceeds the pressure setting of the pressure compensator mechanism and the spool shifts to connect the low pressure conduit to the control port and to the displacement adjustment mechanism to allow the biasing means to increase the displacement of the pump when the pressure of the fluid in the outlet falls below the pressure setting of the pressure compensator mechanism, characterized by means for moving the sleeve in the first bore to change the position of the control port with respect to the spring and spool to thereby adjust the pressure setting of the pressure compensator mechanism, a first area on the sleeve wherein outlet pressure fluid acts on the first area to bias the sleeve and the control port toward the spring to thereby increase the pressure setting of the pressure compensator mechanism and a second area formed on the sleeve, the second area being greater than the first area, means for supplying a control fluid to the second area and control fluid is supplied to the second area to move the sleeve and the control port away from the spring to thereby decrease the pressure setting of the pressure compensator mechanism, the pressure setting being proportional to the pressure of the control fluid, the means for supplying the control fluid including a jet pipe electrohydraulic servo valve having a jet tube and a torque motor and a feedback device which is connected to the sleeve and to the jet tube, the pressure of the control fluid supplied to the second area is proportional to the current input to the torque motor, and at zero current input minimum pressure control fluid is supplied to the second area and the pressure compensator remains at its maximum pressure setting.

* * * * *